United States Patent [19]

Clarke

[11] Patent Number: 5,031,903

[45] Date of Patent: Jul. 16, 1991

[54] VERTICAL JUMP TESTING DEVICE

[76] Inventor: Robert B. Clarke, 1611 Minutemen Causeway, Apt. 304, Cocoa Beach, Brevard County, Fla. 32931

[21] Appl. No.: 574,741

[22] Filed: Aug. 30, 1990

[51] Int. Cl.[5] ..... A63B 5/16

[52] U.S. Cl. ..... 272/93; 273/1.5 A

[58] Field of Search ..... 272/93; 273/1.5; 33/832, 833; 40/459, 460, 450, 446

[56] References Cited

U.S. PATENT DOCUMENTS

| | | | |
|---|---|---|---|
| 2,469,145 | 8/1948 | Baliff | 273/1.5 A |
| 3,012,781 | 10/1959 | Nelson | 273/1.5 A |
| 3,085,800 | 9/1961 | Holstad | 273/1.5 A |
| 3,258,266 | 3/1964 | Kamish | 273/1.5 A |
| 4,208,050 | 6/1980 | Perrine et al. | 273/1.5 A |

*Primary Examiner*—Richard J. Apley
*Assistant Examiner*—Jerome Donnelly
*Attorney, Agent, or Firm*—A. W. Fisher, III

[57] ABSTRACT

A vertical jump testing device comprising a plurality of vertically arranged measuring elements each pivotally mounted on a vertically disposed mounting member and independently movable between a first and second position to measure the vertical leaping ability of an athlete as the athlete strikes and angularly displaces one or more of the plurality of vertically arranged elements from the first position to the second position and a reset mechanism to reset the angularly displaced vertically arranged elements from the second position to the first position.

11 Claims, 2 Drawing Sheets

VERTICAL JUMP TESTING DEVICE

BACKGROUND OF THE INVENTION

1. Field of the Invention

A vertical jump testing device to measure the vertical leaping ability of an athlete.

2. Description of the Prior Art

A common means in training athletes involves measuring and recording an individual's ability to jump upwardly from a standing position generally referred to as the jump reach.

The vertical jumping potential is often measured by having an athlete jump to place a chalk mark as high as possible on a wall or blackboard. While such equipment is simple and inexpensive, such devices require the athlete to execute an approach or jumping motion different from the actual jumping movements which are intrinsic to sports such as basketball and volleyball. Moreover, such equipment is generally limited to standing jumps, rather than running jumps, because the wall or blackboard is an obstruction. In addition, once the athlete has placed an initial mark on the board, there is no specific, higher visual target-height on such prior art equipment that the athlete could strive to reach.

U.S. Pat. No. 4,2098,050 discloses an apparatus for measuring the ability of an athlete to jump vertically including an upright frame having a series of horizontally extending vanes pivotally mounted one above the other in spaced parallel relationship at the upper end of the frame for individual angular movement about a vertical axis. The vanes are retained in uniformly spaced and parallel relationship by a stack of precision spacers and axial-loading spring washers. The vanes are mounted so that each may pivot freely about the vertical axis on an individual basis.

U.S. Pat. No. 4,323,234 shows a jump and reach physical training system for measuring vertical height attained by a person jumping vertically from a standing position including a board having visually perceptible full size scale with equally spaced increments thereon. The board includes appropriate mounting devices that allow the board to be attached to a support above the floor surface and within standing reach of the jumper. The jumper stands flat on the floor and extends his or her arms upwardly to reach a maximum height on the board. The maximum reached height is indicated by the increment covered by the fingertips. This increment is recorded The individual then jumps upwardly in an effort to cover the board at the highest increment possible. This increment is noted to provide a direct reading of the vertical jump.

Additional examples of the prior art are shown in U.S. Pat. No. 2,697,603; U.S. Pat. No. 3,258,266 and U.S. Pat. 3,534,956.

SUMMARY OF THE INVENTION

The present invention relates to a vertical jump testing device comprising a frame mounted to a wall or other support by a mounting means configured to operatively support a measurement means and reset mechanism.

The frame comprises an upper and a lower substantially horizontal frame member held in spaced relationship relative to each other by an elongated substantially vertical frame member. A hollow substantially vertical sleeve having a centrally disposed channel formed therethrough to receive a portion of the measurement means is affixed to the lower substantially horizontal frame member.

The measurement means comprises a plurality of vertically arranged measuring elements each independently movable between a first and second position pivotally mounted on an elongated substantially vertical mounting member.

The upper portion of the elongated substantially vertical mounting member extends through a channel or aperture formed through the upper substantially horizontal frame member; while, the lower portion thereof extends through the centrally disposed channel of the hollow substantially vertical sleeve Each of the plurality of vertically arranged measuring elements comprises a flat substantially vertical member bearing an indicia thereon and a corresponding measuring mounting member.

The reset mechanism comprises an elongated first and second substantially vertical reset member held in parallel spaced relation relative to each other by a flat substantially horizontal upper, intermediate and lower reset plate each includes an aperture formed therein to receive the elongated substantially vertical mounting member therethrough. A reset handle extends downwardly from an extension arm formed on the lower reset plate.

To use, the mounting means is attached to a wall or other support. The frame with the measurement means and reset mechanism is coupled to the mounting means.

The athlete then jumps and strikes the highest reachable of the plurality of vertically arranged measuring elements with his or her upstretched hand to angularly displace one or more of the plurality of vertically arranged measuring elements from the first to the second position about the elongated substantially vertical mounting member. In a series of successive jumps, the athlete seeks to reach higher and higher until his or her vertical jump limit is reached.

The angularly displaced measuring elements are then returned from the second position to the first position by rotation of the reset mechanism such that either the elongated first or second substantially vertical reset member engages the angularly displaced measuring elements.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
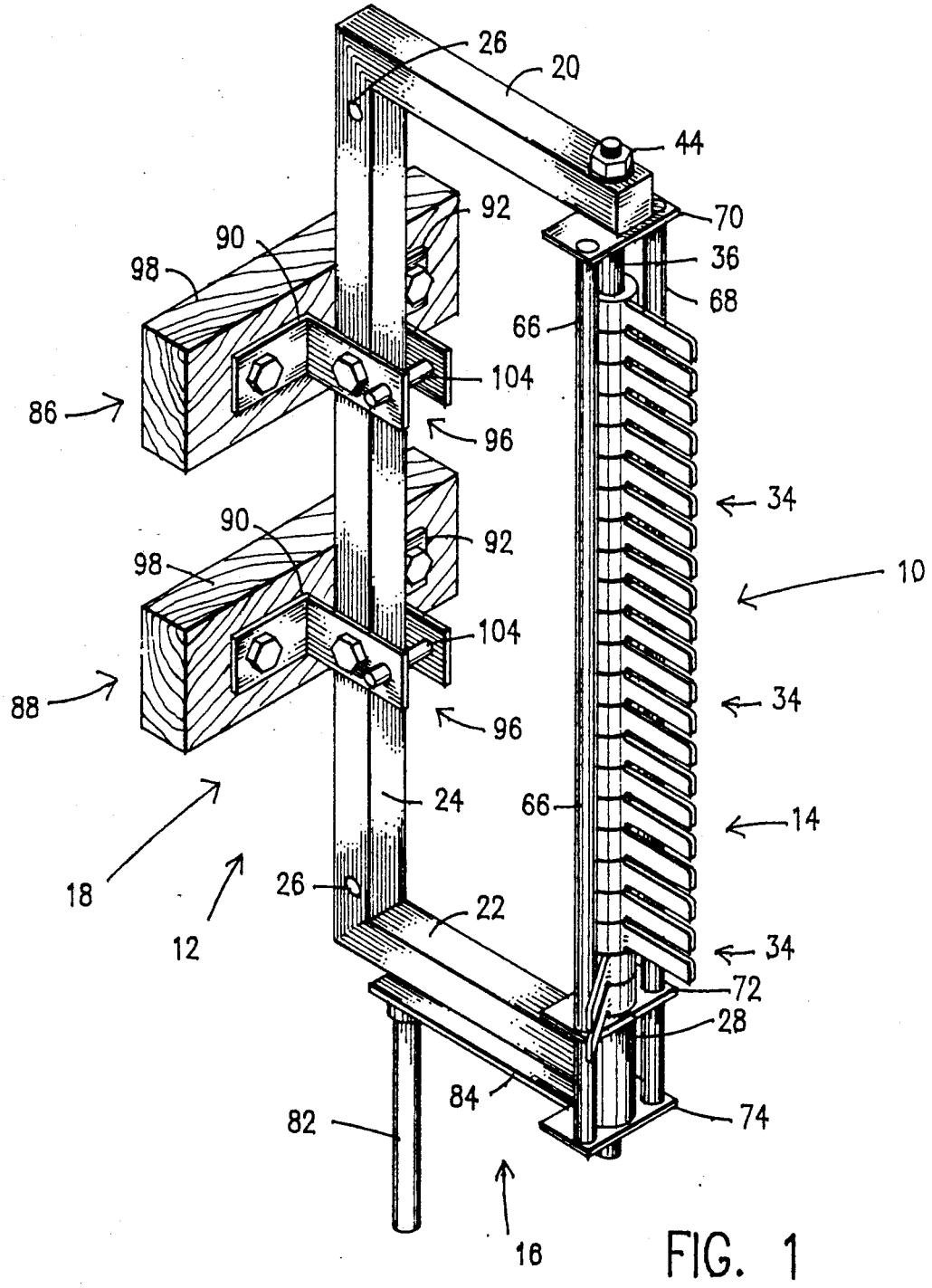
FIG. 1 is a perspective view of the vertical jump testing device.

As best shown in FIG. 1, the present invention relates to a vertical jump testing device generally indicated as 10 comprising a frame generally indicated as 12 configured to operatively support a measurement means and reset mechanism generally indicated as 14 and 16 respectively. The frame 12 is mounted to a wall or other support (not shown) by a mounting means generally indicated as 18.

Figures 2, 3:
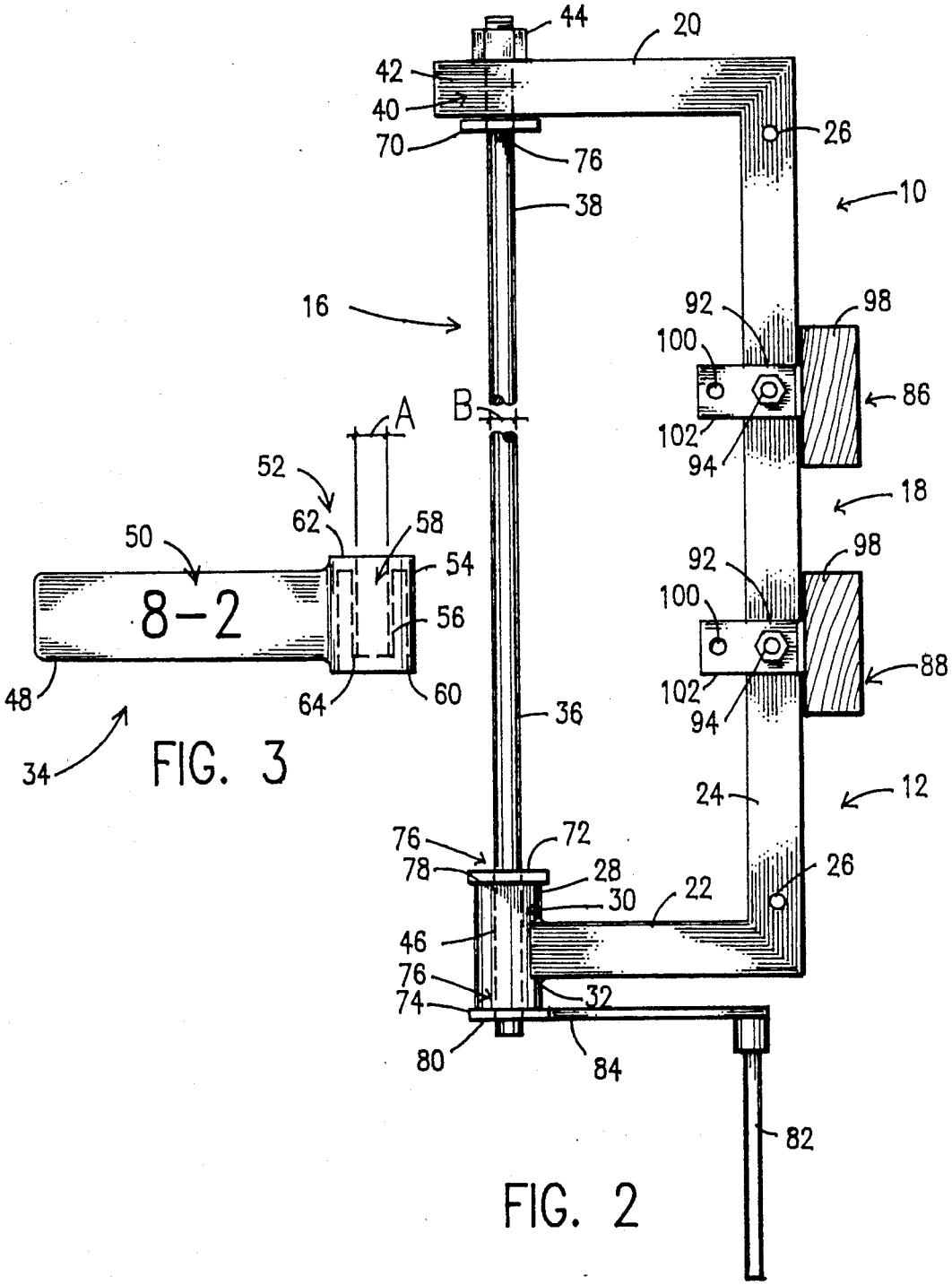
FIG. 2 is a partial side view of the vertical jump testing device.
FIG. 3 is a side view of the measuring element.

As best shown in FIGS. 1 and 2, the frame 12 comprises an upper and a lower substantially horizontal frame member indicated as 20 and 22 respectively held in spaced relationship relative to each other by an elongated substantially vertical frame member 24. A plurality of frame mounting apertures each indicated as 26 are equally spaced along the elongated substantially vertical frame member 24 to permit vertical adjustment of the vertical jump testing device as described more fully hereinafter. A hollow substantially vertical sleeve 28 having a centrally disposed channel 30 formed therethrough to receive a portion of the measurement means 14 as described more fully hereinafter is affixed to the outer portion 32 of the lower substantially horizontal frame member 22.

As best shown in FIG. 1, the measurement means 14 comprises a plurality of vertically arranged measuring elements each generally indicated as 34 pivotally mounted on an elongated substantially vertical mounting member 36. As best shown in FIG. 2, the upper portion 38 of the elongated substantially vertical mounting member 36 extends through a channel or aperture 40 formed through the outer portion 42 of the upper substantially horizontal frame member 20 and affixed thereto by a fastener means 44. The lower portion 46 of the elongated substantially vertical mounting member 36 extends through the centrally disposed channel 30 of the hollow substnatially vertical sleeve 28.

As best shown in FIG. 3, each of the plurality of vertically arranged measuring elements 34 comprises a flat substantially vertical member 48 bearing an indicia 50 thereon and a corresponding measuring mounting member generally indicated as 52. Each corresponding measuring mounting member 52 comprises an outer cylindrical substantially vertical measuring mounting element 54 and an inner cylindrical substantially vertical measuring mounting element 56 having a centrally disposed channel 58 formed therethrough disposed in spaced relationship thereto. The inside diameter A of the centrally disposed channel 58 is slightly less than the outside diameter B of the elongated substantially vertical mounting member 36 such that each of the plurality of vertically arranged measuring elements 34 is press fitted on the elongated substantially vertical mounting member 36. The lower surface 60 of each outer cylindrical substantially vertical measuring mounting element 54 rests on the upper surface 62 of the outer cylindrical substantially vertical measuring mounting element 54 disposed immediately below thereto; while, the lower surface 64 of each inner cylindrical substantially vertical measuring mounting element 56 is disposed in spaced relationship relative to the upper surface 62 of the outer cylindrical substantially vertical measuring mounting element 54 disposed immediately below thereto.

As best shown in FIGS. 1 and 2, the reset mechanism 16 comprises an elongated first and second substantially vertical reset member indicated as 66 and 68 respectively held in parallel spaced relation relative to each other by flat substantially horizontal upper, intermediate and lower reset plate indicated as 70, 72 and 74 respectively. The flat substantially horizontal upper, intermediate and lower reset plate 70, 72 and 74 each includes an aperture 76 formed therein to receive the elongated substantially vertical mounting member 36 therethrough. The intermediate and lower reset plate 72 and 74 are disposed immediately adjacent the upper and lower surfaces 78 and 80 respectively of the hollow substantially vertical sleeve 28. A reset handle 82 extends downwardly from an extension arm 84 formed on the lower reset plate 74.

As best shown in FIGS. 1 and 2, the mounting means 18 comprises an upper and lower mounting bracket generally indicated as 86 and 88 respectively. The upper and lower mounting bracket 86 and 88 each comprises a first and second mounting element indicated as 90 and 92 respectively, each including a mounting aperture 94 formed therein, disposed in spaced relationship relative to each other to cooperatively form a frame channel 96 therebetween to receive the substantially vertical frame member 24 affixed to a mounting member 98 which in turn is mounted to a wall or other support (not shown). Of course, each pair of first and second mounting elements 90 and 92 may be affixed directly to the wall or other support (not shown). A stabilizer aperture 100 is formed in the outer portion 102 of each first and second mounting element 90 and 92 to selectively receive a stabilizer pin 104 therethrough as described more fully hereinafter.

To use, the mounting means 18 is attached to a wall or other support (not shown). The frame 12 with the measurement means 14 and reset mechanism 16 mounted thereon is coupled to the mounting means 18 by passing a connector pins 106 through the corresponding pairs of mounting apertures 94 formed through the corresponding first and second mounting elements 90 and 92 and adjacent frame mounting aperture 26. The frame 12 may be adjusted vertically by the selection of the frame mounting apertures 26 used. The frame 12 is stabilized from outward movement relative to the mounting means 18 by the stabilizer pins 104.

The athlete then jumps and strikes the highest reachable flat substantially vertical member 48 with his or her upstretched hand to angularly displace one or more of the flat substantially vertical member 48 from the first to the second position about the elongated substantially vertical mounting member 36. In a series of successive jumps, the athlete seeks to strike higher and higher until his or her vertical jump limit is reached.

The angularly displaced flat substantially vertical members 48 are then returned from the second position to the first position by rotation of the reset mechanism 16 such that either the elongated first or second substantially vertical reset member 66 or 68 engages the angularly displaced flat substantially vertical members 48. The indicia 50 that provide an incremental indication of the height above the floor permit a visual measure of the athlete's vertical jump.

The frame 12 together with the measurement means 14 and reset mechanism 16 may be adjusted vertically by selecting different pairs of the frame mounting aperture 26.

Rotation of the reset mechanism 16 is limited by the engagement of the elongated first and second substantially vertical members 66 and 68 with the upper and lower substantially horizontal members 20 and 22 to reset the angularly displaced flat substantially vertical members 48 to the first position.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A vertical jump testing device comprising a plurality of vertically arranged measuring elements each pivotally mounted on an elongated substantially vertically disposed mounting member and independently movable between a first and second position to measure the vertical leaping ability of an athlete as the athlete strikes and angularly displaces one or more of said plurality of vertically arranged elements from said first position to said second position and a reset mechanism movable between a first and second position to reset said angularly displaced vertically arranged elements from said second position to said first position when said reset mechanism is moved from said first position to said second position said reset mechanism comprises an elongated first substantially vertical reset member and an elongated second substantially vertical reset member held in parallel spaced relation relative to each other by an upper and lower reset plate, said elongated first substantially vertical reset member and said elongated second substantially vertical reset member being disposed to selectively engage said angularly disposed vertically arranged elements when said reset mechanism is moved from said first position to said second position.

2. The vertical jump testing device of claim 1 wherein each of said plurality of vertically arranged measuring elements comprises a flat substantially vertical member bearing an indicia thereon and a corresponding measuring mounting member.

3. The vertical jump testing device of claim 2 wherein each corresponding measuring mounting member comprises an outer cylindrical substantially vertical measuring mounting element and an inner cylindrical substantially vertical measuring mounting element having a centrally disposed channel formed therethrough disposed in spaced relationship thereto.

4. The vertical jump testing device of claim 3 wherein the inside diameter of said centrally disposed channel is slightly less than the outside diameter of said elongated substantially vertical mounting member such that each of said plurality of vertically arranged measuring elements is press fitted on said elongated substantially vertical mounting member.

5. The vertical jump testing device of claim 4 wherein the lower surface of each said outer cylindrical substantially vertical measuring mounting element rests on the upper surface of said outer cylindrical substantially vertical measuring mounting element disposed immediately below thereto.

6. The vertical jump testing device of claim 5 wherein the lower surface of each said inner cylindrical substantially vertical measuring mounting element is disposed in spaced relationship relative to the upper surface of said outer cylindrical substantially vertical measuring mounting element disposed immediately below thereto.

7. The vertical jump testing device of claim 1 futher including a frame comprising an upper and lower substantially horizontal frame member held in spaced relationship relative to each other by an elongated substantially vertical frame member.

8. The vertical jump testing device of claim 7 wherein said frame further includes a hollow substantially vertical sleeve having a centrally disposed channel formed therethrough affixed to the outer portion of said lower substantially horizontal frame member to receive said elongated substantially vertical mounting member therethrough.

9. The vertical jump testing device of claim 8 wherein said flat substantially horizontal upper, an intermediate and said lower reset plate each includes an aperture formed therein to receive said elongated substantially vertical mounting member therethrough and said intermediate and lower reset plate are disposed immediately adjacent the upper and lower surfaces respectively of said hollow.

10. The vertical jump testing device of claim 1 wherein said reset mechanism further includes a reset handle extending downwardly rom an extension arm formed on said lower reset plate.

11. The vertical jump testing device of claim 7 further includes a mounting means comprising upper and lower mounting bracket, said upper and lower mounting bracket each comprises a first and second mounting element, each including a mounting aperture formed therein disposed in spaced relationship relative to each other to cooperatively form a frame channel therebetween to receive said elongatged substantially vertical frame member.

* * * * *